US005182814A

United States Patent [19]

Christensen

[11] Patent Number: 5,182,814

[45] Date of Patent: Feb. 2, 1993

[54] WEIGHT SUPPORTING GLOVE

[76] Inventor: Kenneth Christensen, 777 S. 400 East, No. 25, St. George, Utah 84770

[21] Appl. No.: 572,257

[22] Filed: Aug. 27, 1990

[51] Int. Cl.[5] ..... A41D 19/00

[52] U.S. Cl. ..... 2/161 A

[58] Field of Search ..... 2/17, 160, 161 A, 162, 2/161 R, 16, DIG. 6; 272/143, 119, 123, 67

[56] References Cited

U.S. PATENT DOCUMENTS

| | | | |
|---|---|---|---|
| 2,852,779 | 9/1958 | Roessler | 2/161 A |
| 3,105,972 | 10/1963 | Christopher | 2/161 A |
| 4,247,097 | 1/1981 | Schwartz | 272/119 |
| 4,691,387 | 9/1987 | Lopez | 2/161 A |
| 4,777,666 | 10/1988 | Beverlin | 2/161 A |
| 4,793,005 | 12/1988 | Hetzel, Jr. | 2/161 A |
| 4,796,306 | 1/1989 | Mitchell | 2/161 A X |
| 4,905,321 | 4/1990 | Walunga | 2/161 A |
| 5,004,231 | 4/1991 | Alread | 2/161 A X |

FOREIGN PATENT DOCUMENTS

| | | | |
|---|---|---|---|
| 2565213 | 12/1985 | France | 2/162 |
| 1549525 | 8/1979 | United Kingdom | 2/17 |

*Primary Examiner*—Werner H. Schroeder
*Assistant Examiner*—Sara M. Current
*Attorney, Agent, or Firm*—Mallinckrodt & Mallinckrodt

[57] ABSTRACT

A weight supporting glove has a flap attached thereto near the heel which extends distally toward the fingertips. The flap is equipped with a Velcro or similar type fastener on its distal end which cooperates with a mating Velcro strip on the palm of the glove. In use, the flap is wrapped around the handle of a barbell or similar weight and fastened to the palm of the glove to form a loop which assists in supporting the weight.

20 Claims, 4 Drawing Sheets

WEIGHT SUPPORTING GLOVE

BACKGROUND OF THE INVENTION

1. Field

This invention relates to gloves worn for weight lifting activities.

2. State of the Art

A number of prior art gloves disclose flaps used in various capacities. For example, U.S. Pat. No. 2,852,779, issued to E. W. Roessler, shows a glove having a stretchable strap attached to the back of the glove which is designed to wrap around the outside of a closed hand which grasps a golf club or similar sports paraphenalia. The object of that invention is to provide a method of maintaining the alignment of the club during the course of the swing. This is accomplished by preventing the wearer's natural tendency to release the grip on the club shaft by the directing hand. However, this patent does not disclose or suggest a flap designed to hold substantial weights.

Similarly, U.S. Pat. No. 3,105,972, issued to J. A. Christopher, discloses another stretchable strap. Although this patent differs from the 779 patent in that the flap is attached to the wearer's palm, the object thereof is exactly the same, i.e. to secure the wearer's grasp to the handle of a golf club. The 972 and the 779 patents are unable to bear substantial weight on the flaps because they are made of a stretchable material.

Gloves that are capable of holding weights are also known in the art. By way of example, U.S. Pat. No. 4,247,097, issued to L. Schwartz, discloses a glove onto which a number of pockets are sewn. Small weights are inserted into these pockets for use during an aerobic-type exercise. Such gloves are incapable, however, of assisting the wearer in lifting heavy weights, nor is such suggested or taught by the 097 patent.

SUMMARY OF THE INVENTION

In brief summary, the present invention comprises a glove having a palm side and wrist encompassing portion. A flap is attached to the wrist encompassing portion of the glove and extends distally from the glove near the heel end of the palm portion toward the fingertip end. The flap has a hook and loop type fastener strip attached at the distal end thereof which cooperates with a mating hook and loop type fastener strip on the palm portion of the glove so that the flap can be formed into a weight supporting loop.

The wrist encompassing portion of the glove includes a set of cooperating straps with mating hook and loop type fastener attached thereto to secure the glove about the wearer's wrist. A second set of cooperating hook and loop type fastener straps may be provided to tighten the glove across the back of the hand. The glove is preferrably made with only half fingers although full fingers may also be used.

In use, the flap is wrapped around the handle portion of a barbell to be lifted and the palm and distal end flap hook and loop type fastener strips are engaged, thus forming a loop to help the fingers support the weight. The weight supported by the loop is transmitted through the glove, and particularly the wrist encompassing portion thereof to the wrist and hand of the user.

THE DRAWINGS

In the drawings, which illustrate the best mode presently contemplated for carrying out the invention in actual practice:

FIG. 1 represents a preferred weight supporting glove showing the palm side with flap extended, according to the invention;

FIG. 2, a palm side view of the glove of FIG. 1 with the flap folded over and not in use;

FIG. 3, a back side view of the glove of FIG. 1 illustrating a preferred wrist closure;

FIG. 4, a back side view similar to FIG. 3 showing a second preferred wrist encompassing closure plus optional hand closure;

FIG. 5, a partial front view of two gloves of FIG. 1, illustrated in the "as used" position; and FIG. 6, a side view of a glove of FIG. 5, taken on the line 6—6 of FIG. 5.

DETAILED DESCRIPTION OF THE ILLUSTRATED EMBODIMENT

Figure 1:
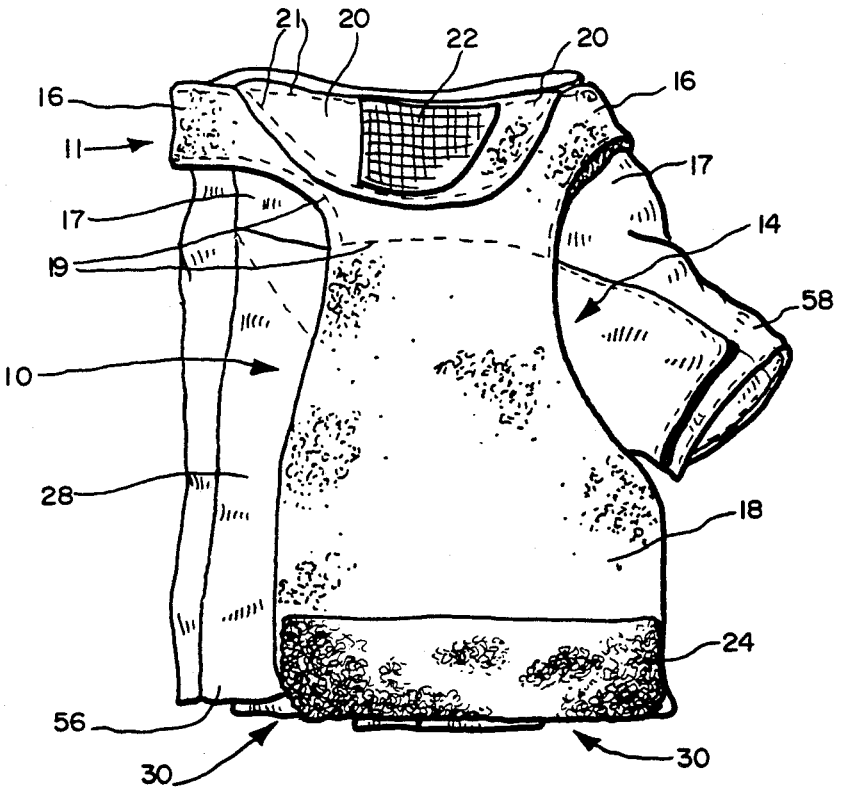
Figure 3:
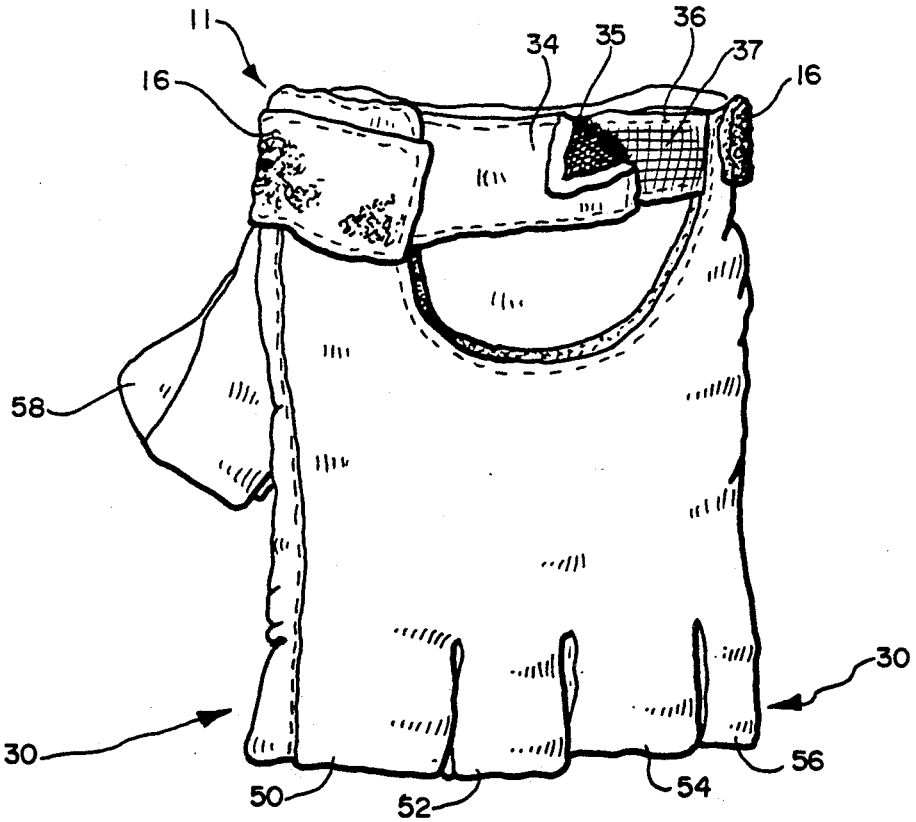

As illustrated, a preferred embodiment of the invention includes a glove having a front or palm portion, generally 10, and a wrist portion, generally 11. The wrist portion may be adjustably secured about a wearer's wrist. The glove may be made of leather, nylon, or other strong, flexible material, with the wrist portion of the glove being of material not allowing substantial stretching. A flap 14 has an attached portion 16 secured, such as by stitching 19, to the wrist portion 11 of the glove. An unattached, free portion 18 of the flap extends distally from the heel or base of the palm towards the fingers of the glove. As with the glove, the flap may be made of various materials such as leather, nylon, or a heavy cotton. However, the flap materials should not allow substantial stretching. The attachment of the flap extends from the heel or base 17 of the palm portion 10 of the glove at least partially about the wrist portion as best illustrated in FIGS. 1 and 3. A reinforcing piece 20 may be sewn, such as by stitching 21, onto the wrist portion of the glove over attached portion 16 to prevent tearing during use.

Figure 2:
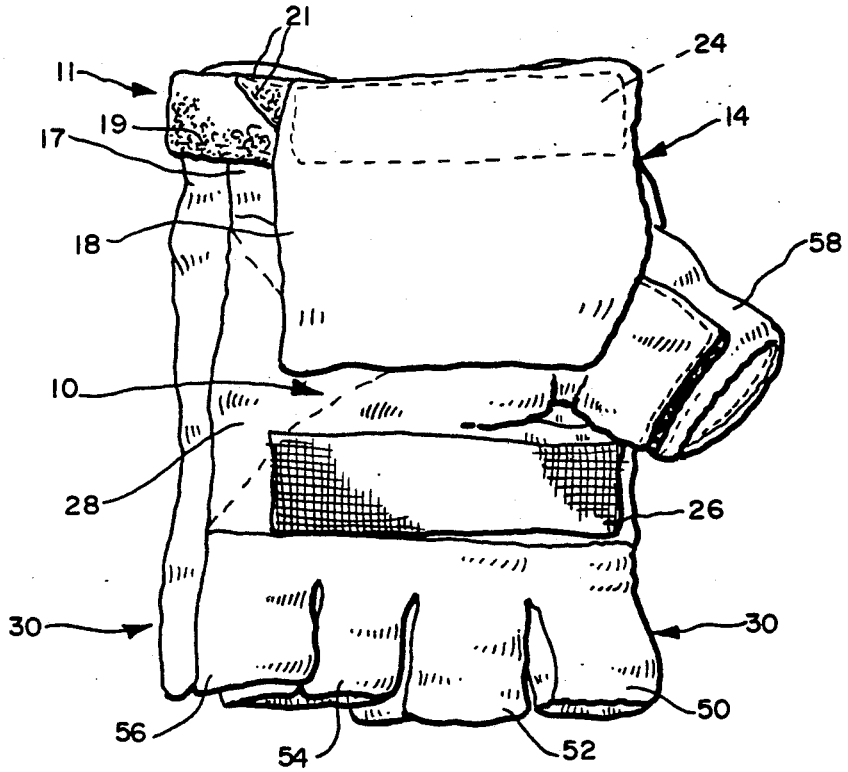
Figure 5:
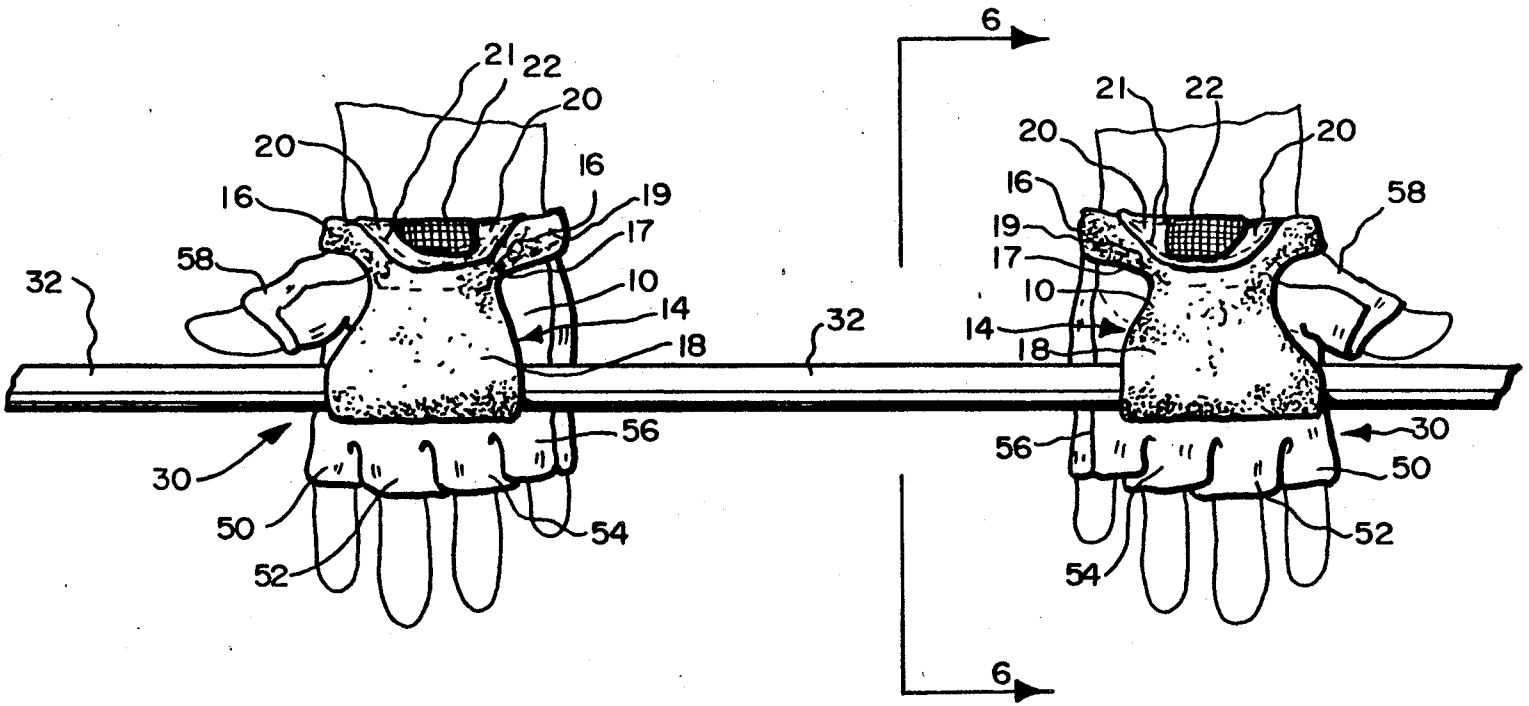

A receiving hook and loop type fastener 22, such as a Velcro ® fastener is sewn onto reinforcing piece 20 and cooperates, when flap 14 is not in use and is folded upwardly, with another hook and loop type fastener 24 which is sewn to the outside face of unattached portion 18 of flap 14, as shown in FIGS. 1 and 2. When flap 14 is in use, hook and loop type fastener 24 cooperates with another receiving hook and loop type fastener 26 which is sewn to the palm portion 10 of the glove near where finger sections 30 begin. Hence, when hook and loop type fasteners 24 and 26 are in cooperation with each other, flap 14 forms a loop which encompasses the handle 32, FIGS. 5 and 6, of a weight such as a barbell. Because of the construction of flap 14, much or all of the weight supported by the flap when in use is transferred to the attached portion 16 of the flap, and to the wrist portion 11 of the glove, which extends about the wrist of the user. This relieves a substantial portion, if not all, of the force required to be supplied by the user's fingers in grasping the weight. This weight or force is transferred through the flap and glove to the user's wrist and/or hand. When lifting weights on a regular basis, often the fingers tire well before the muscles sought to be exercised. It is therefor desirable to have a glove, such as the present one, which helps the fingers support a large weight during a pulling exercise.

Figure 4:
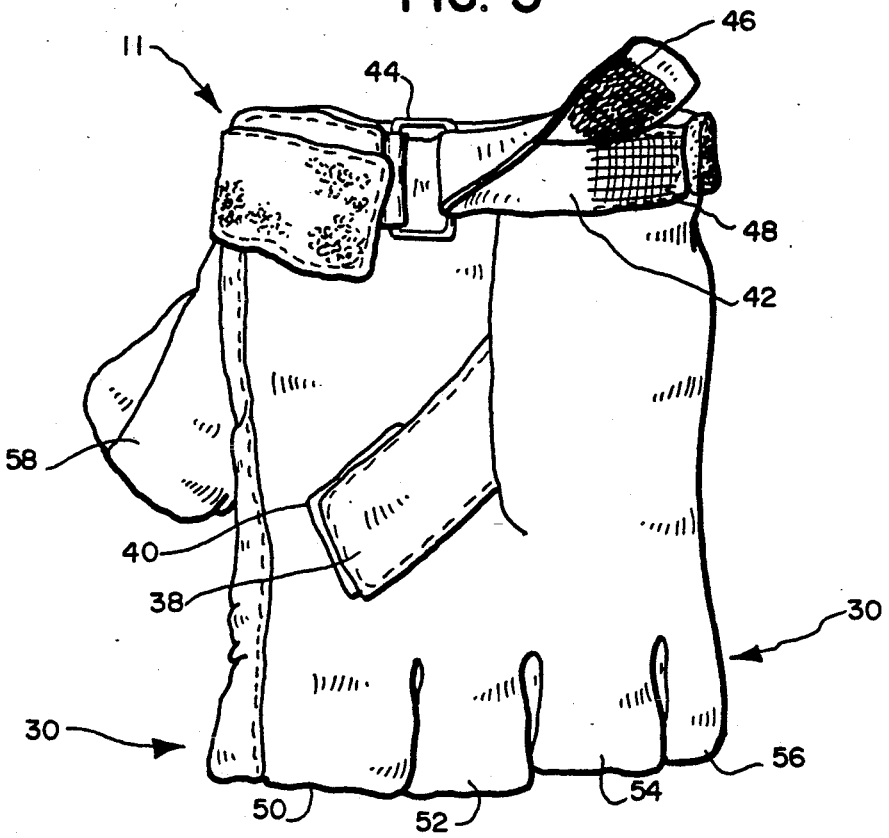

The wrist portion 11 of the glove includes straps 34 and 35, FIG. 3, with cooperating hook and loop type fasteners 36 and 37, which serve to adjust the wrist portion of the glove about the wrist of a user and secure it about the user's wrist to prevent the glove from coming off when weight is lifted. If desired, an additional strap 38 with hook and loop type fastener 39, FIG. 4, may be provided to cooperate with a mating hook and loop type fastener 40 on the back of the glove to tighten the glove across the back of the user's hand to help maintain a snug fit of the glove. An alternate method of adjusting and securing the wrist portion of the glove is shown in FIG. 4. As shown, a strap 42 is inserted through an attached metal loop 44 and is doubled back on itself. Hook and loop type fasteners 46 and 48 on strap 42 are then placed in cooperation with one another to secure the strap.

The wrist portion of the glove may vary greatly in width. A relatively narrow wrist portion is shown in the figures, but has been found to work satisfactory in most weight lifting situations. If desired, however, the wrist portion could be made wider to extend further up the wrist toward the arm of the user to spread the weight supported by the flap of the glove over a wider portion of the wrist and to offer further support to the wrist during lifting.

The finger portions 50, 52, 54 and 56, and thumb portion 58 of the glove, are preferrably cut off at the ends thereof, thus leaving the wearer's fingertips exposed for ventilation purposes, although such finger portions could completely enclose the fingers, if desired.

Figure 6:
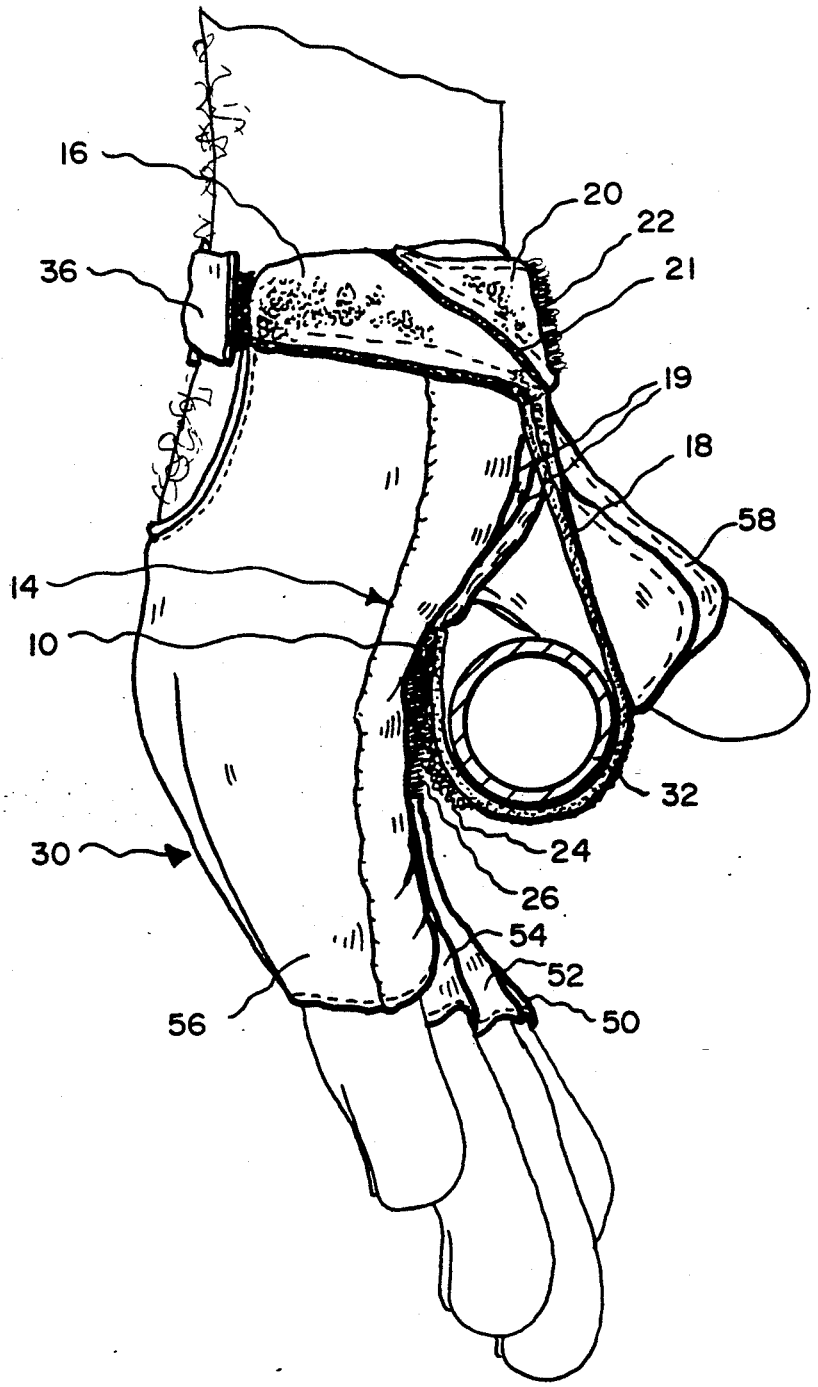

In use, a weight lifter puts the gloves of the invention on his hands, adjusts the fit of the gloves around the wrist with the wrist straps and adjusts the fit across the hand with strap 38, if provided. He then assumes the normal position for grasping the weight, such as the barbell to be lifted, but prior to grasping the bar, he loops flap 18 around the bar and secures the hook and loop type fastener strip 24 on the end of flap 18 to mating hook and loop type fastener strip 26 on the palm of the hand to form a loop as shown in FIG. 6. It has been found that with the illustrated flap and hook and loop type fastener arrangement, the flap can be easily looped around the bar and secured, as shown, with the single hand involved. It can also be easily released when lifting is completed.

The flap and the mating hook and loop type fastener strips, or other fastening means used, should be sized and positioned so that preferably, the bottom of the loop formed to support the bar is at the same level as the fingers when wrapped about the bar so that the weight to be lifted is at least partially supported through the glove by the user's wrist and hand, in addition to the user's fingers. This allows a weight lifter to lift more weight and for a longer period of time than is the case when all of the lifted weight is supported by the fingers. With the illustrated fastening of the end of the flap to the palm, the user can easily make small adjustments in the position of attachment to adjust the size of the loop as desired.

The relative sizes of the flap and glove are not critical nor is the specific positioning of the various attachment means. The important feature is that the flap can be looped around a weight to be lifted and secured to the palm portion of the glove so that a weight supporting loop is formed which transfers weight from the fingers of the hand to the wrist and/or other portions of the hand. Further, the attached portion of the flap may extend completely around the wrist rather than partially around the wrist as shown, or, depending upon the construction of the wrist portion of the glove, could be integral therewith, or be attached otherwise than as shown.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A weight supporting glove comprising:

a glove including a palm portion having a heel end, a wrist portion adjacent the heel end of the palm portion and adapted to extend around a wearer's wrist, and first fastening means for adjustably securing the wrist portion of the glove around a wearer's wrist;

a flap having an attached portion secured to the wrist portion of the glove at least substantially continuously along the heel end of the palm portion from side to side of the glove and having an unattached distal portion; and second fastening means for releasibly securing the unattached distal portion of the flap to the palm portion of the glove to form a loop for supporting a weight.

2. A weight supporting glove according to claim 1, wherein said first fastening means are straps with cooperating hook and loop type fasteners.

3. A weight supporting glove according to claim 1, wherein said first fastening means is a metal loop and a single strap having cooperating hook and loop type fasteners, said single strap being passed through the metal loop and doubled back onto itself.

4. A weight supporting glove according to claim 1, wherein said attached portion of the flap is secured to the wrist portion of the glove by stitching.

5. A weight supporting glove according to claim 1, wherein said unattached distal portion of the flap has an inside and an outside broad face, and wherein said second fastening means secures the outside broad face of the unattached distal portion of the flap to the palm portion of the glove.

6. A weight supporting glove according to claim 5, wherein said second fastening means are cooperating hook and loop type fasteners.

7. A weight supporting glove according to claim 1, further comprising a plurality of finger portions.

8. A weight supporting glove according to claim 7, wherein the finger portions of the glove do not completely encapsulate the wearer's fingers.

9. A weight supporting glove according to claim 1, wherein said attached portion of the flap has third fastening means for securing the distal end of the flap thereto when not in use.

10. A weight supporting glove according to claim 9, wherein said third fastening means are cooperating hook and loop type fasteners.

11. A weight supporting glove according to claim 1, wherein the attached portion of the flap extends at least partially around the wrist portion of the glove so as to at least partially encircle the wrist of a wearer of the glove.

12. A weight supporting glove comprising:

a glove including a palm portion having a heel end, a wrist portion located adjacent the heel end of the palm portion and adapted to extend across the wrist of a user adjacent the palm, finger portions extending from an end of the palm portion opposite the heel end thereof, and a thumb portion extending from the palm portion;

a flap having an attached portion secured to the wrist portion of the glove substantially continuously along the heel end of the palm portion from side to side of the glove and having an unattached distal portion; and fastening means secured to the palm portion of the glove for releasibly securing the unattached distal portion of the flap to the palm portion of the glove to form a loop for supporting a weight.

13. A weight supporting glove according to claim 12, wherein said attached portion of the flap is secured to the wrist portion of the glove by stitching.

14. A weight supporting glove according to claim 12, wherein said unattached distal portion of the flap has an inside and an outside broad face, and wherein said fastening means secures the outside broad face of the unattached distal portion of the flap to the palm portion of the glove.

15. A weight supporting glove according to claim 14, wherein said fastening means are cooperating hook and loop type fasteners secured to the palm portion of the glove and to the outside broad face of the distal end of the flap.

16. A weight supporting glove according to claim 14, wherein the fastening means secured to the palm portion is secured to the palm portion intermediate the thumb and finger portions.

17. A weight supporting glove according to claim 14, wherein the broad faces of the flap are of a width at least as wide as two finger portions of the glove.

18. A weight supporting glove according to claim 12, wherein the fastening means secured to the palm portion is secured to the palm portion intermediate the thumb and finger portions.

19. A weight supporting glove according to claim 12, wherein the attached portion of the flap extends at least partially around the wrist portion of the glove so as to at least partially encircle the wrist of a wearer of the glove.

20. A weight supporting glove according to claim 12, wherein the flap has a length and a distal end, and the length extends from the wrist portion to intermediate the length of the finger of a wearer of the glove.

* * * * *